US008201822B2

(12) United States Patent
Hochreiter

(10) Patent No.: US 8,201,822 B2
(45) **Date of Patent: *Jun. 19, 2012**

(54) PLANAR-MEDIA-FEED APPARATUS

(75) Inventor: Eric P. Hochreiter, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 181 days.

This patent is subject to a terminal disclaimer.

(21) Appl. No.: 12/713,257

(22) Filed: Feb. 26, 2010

(65) Prior Publication Data

US 2011/0210496 A1 Sep. 1, 2011

(51) Int. Cl.
*B65H 1/12* (2006.01)

(52) U.S. Cl. ..... 271/160; 271/145

(58) Field of Classification Search ..... 271/145, 271/147, 160, 171

See application file for complete search history.

(56) References Cited

U.S. PATENT DOCUMENTS 5,085,419 A 2/1992 Bell
5,199,695 A * 4/1993 Nakahata et al. ..... 271/9.12
5,640,664 A 6/1997 Ukei et al.
7,267,336 B2 * 9/2007 Kojima ..... 271/145
7,376,381 B1 5/2008 Black
2004/0253032 A1 12/2004 Kojima
2009/0189336 A1 7/2009 Otake
2011/0210497 A1 * 9/2011 Hochreiter ..... 271/18

FOREIGN PATENT DOCUMENTS

EP 1 591 259 A2 11/2005
JP 06-211364 8/1994

* cited by examiner

*Primary Examiner* — Michael McCullough
(74) *Attorney, Agent, or Firm* — Christopher J. White

(57) ABSTRACT

Apparatus for feeding a planar medium from a host tray with a media cavity, including a feed edge adjacent to which the medium is extracted, a sidewall perpendicular to the feed edge, and a spring plate for lifting the medium towards a feeder; a media carrier nested in the cavity, including an edge guide to prevent the medium from moving toward the sidewall, the edge guide having an alignment face for orienting the medium with respect to the feed edge; and an alignment guide in the cavity and having a media guide and a baseplate wider than the medium and disposed over the spring plate, so that the baseplate is lifted when the spring plate lifts. The alignment face and alignment guide together prevent the medium from skewing with respect to the feed edge while the medium is extracted by the feeder.

12 Claims, 10 Drawing Sheets

PLANAR-MEDIA-FEED APPARATUS

CROSS-REFERENCE TO RELATED APPLICATIONS

Reference is made to commonly assigned application Ser. No. 12/713,289 (U.S. Publication No. 2011/0210497 on Sep. 1, 2011), filed Feb. 26, 2010, and entitled "PLANAR MEDIA-FEED METHOD," by Eric Hochreiter, the disclosure of which is incorporated by reference herein.

FIELD OF THE INVENTION

This invention pertains to the field of feeding planar media, e.g. in a printer or copier, and more particularly, to feeding media of different sizes.

BACKGROUND OF THE INVENTION

Image reproduction machines such as electrophotographic printers and copiers are required to print on media, e.g. paper, of various sizes, e.g. letter and A4. Photographic printers such as those used in minilabs are required to print on a wide range of sizes, including 8"×10", 4"×8", and 3.5"×5". Such machines typically include a paper-feed tray for feeding cut sheets of paper of various sizes sequentially into the printer. However, such trays typically have a minimum media size, and specifically a minimum media width. In order to use media with a width smaller than the minimum with such a printer, a different tray or a specialized adapter is required. Furthermore, it is desirable to make an adapter which requires no changes to the printer. Additionally, it is important that media be fed with reduced skew, i.e. angular deviation from sheet to sheet.

U.S. Pat. No. 5,085,419 to Bell describes a feeder insert tray for feeding smaller media. The insert tray is placed on top of larger media already in a media tray in the printer. This permits feeding smaller media from the insert tray without having to remove the larger media from the media tray. However, this scheme requires the media tray to contain some larger-size media. Moreover, the insert tray can fail to provide consistent performance over long print runs, and is subject to operator error during insertion and removal. Moreover, this scheme does not permit the use of a spring plate for lifting the media, as is common on the residential and business printers.

U.S. Patent Publication No. 2004/0253032 to Kojima describes an auxiliary tray frame attached to a tray unit for holding small-size media. However, the auxiliary tray frame extends laterally beyond the footprint of the tray unit, and therefore requires a tray unit and printer designed to accept the auxiliary frame. This makes retrofitting a printer to print on smaller-sized media very difficult with this scheme. Furthermore, this scheme uses a bias spring to hold media laterally, and so does not provide a smooth, low-skew path for the media to be extracted from the tray.

U.S. Pat. No. 7,376,381 to Black describes a paper guide mechanism installed in a printer tray to guide paper having a reduced width compared to a particular allowed paper size. However, this scheme can require fastening the paper guide mechanism to the printer tray, increasing the time and cost of media-size changes. Moreover, this scheme does not provide improved skew performance over the original tray.

There is a continuing need, therefore, for an improved media-feed mechanism which permits using media that is narrower than the minimum width of a particular media tray.

SUMMARY OF THE INVENTION

According to the present invention, there is provided a media-feed apparatus for feeding a planar medium, comprising:

a) a feeder;

b) a host tray out of which the medium is extracted by the feeder, including a feed edge adjacent to which the medium is extracted, a sidewall perpendicular to the feed edge, a cavity adjacent to the sidewall for holding the medium, and a spring plate laterally contained within the cavity for lifting the medium towards the feeder;

c) a media carrier nested immovably in the cavity and laterally contained within the cavity, and including an edge guide positioned relative to the feed edge and the sidewall to prevent the medium from moving toward the sidewall, the edge guide having an alignment face spaced apart from the sidewall and positioned relative to the sidewall to orient the medium with respect to the feed edge;

d) an alignment guide laterally contained within the cavity and having a media guide and a baseplate of a selected width greater than the width of the medium and disposed over the spring plate, so that the baseplate is lifted when the spring plate lifts; and e) wherein the alignment guide is positioned relative to the alignment face and the media guide is positioned relative to the baseplate and the alignment face and is oriented relative to the sidewall to hold the medium so that the alignment face and alignment guide together prevent the medium from skewing with respect to the feed edge while the medium is extracted by the feeder.

An advantage of this invention is that it provides a media-feed apparatus that is easy for an operator to install and remove, particularly in embodiments in which the media carrier and alignment guide are not fastened to the host media tray provided with a printer. This invention provides reduced interference with existing systems in the host tray, e.g. a spring lift, thereby providing narrower paper in a way transparent to the printer. This invention provides reduced or no interference with existing systems outside the host tray, as its components are laterally contained within the host tray. This invention also provides tight skew tolerances and repeatable performance. This invention also permits feeding of smaller-sized media without interfering with the normal media presence detection of a printer.

The attached drawings are for purposes of illustration and are not necessarily to scale.

DETAILED DESCRIPTION OF THE INVENTION

Throughout this disclosure, "parallel to" and "perpendicular to" have a tolerance of ±5°. Furthermore, as applied to surfaces, these terms refer to overall, not instantaneous normals of the surfaces. Bumps or textures on a surface do not prevent it from being parallel with another surface if e.g. the average normals of those parts are parallel or the longest vectors that can be contained within the parts are parallel.

Figure 2:
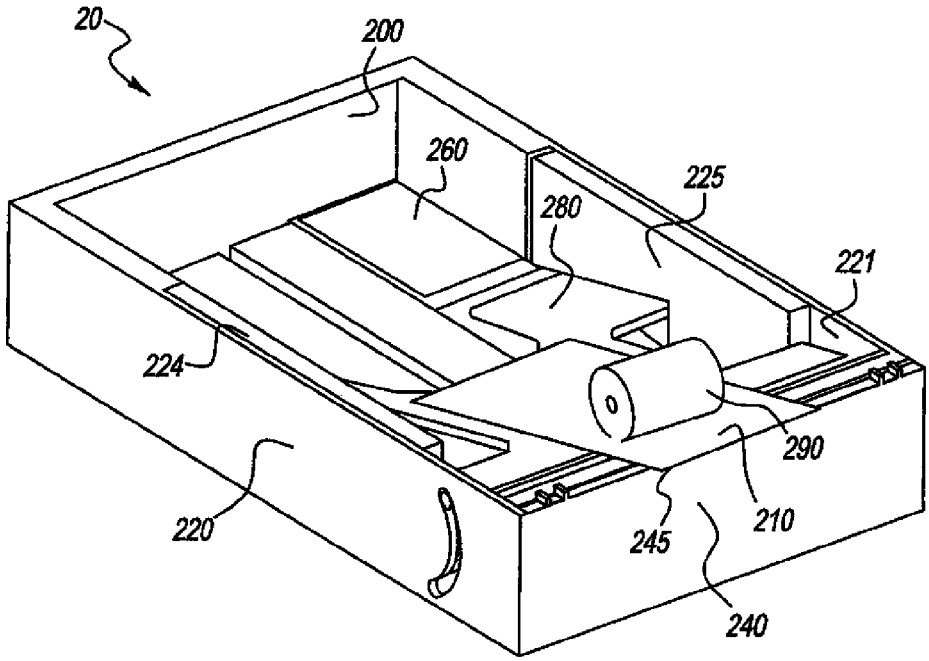
FIG. 2 is an isometric view of a media-feed apparatus according to an embodiment of the present invention.

"Laterally contained" means that no portion of one part, e.g. spring plate 280 of FIG. 2, extends past the boundary of another part, e.g. cavity 260, in the X and Y directions shown in FIG. 2.

"Adjacent to" means that two parts are spatially disposed in close proximity. Parts adjacent to each other can be in mechanical contact at one or more points, but that is not required. Two parts that are "adjacent" are not separated at their closest points by any other parts which affect the function resulting from the adjacency.

"Planar" refers to any part or surface extending primarily in two orthogonal directions, and much less in the third orthogonal direction than in the first two. For example, a plastic shelf can have a molded-in texture. The shelf extends a significant direction in width and depth (e.g. ≧0.3048 m/1 ft), but only a much smaller direction in height (e.g. <1 mm). The shelf is therefore considered "planar," as the term is used in this disclosure.

"Spaced apart" means that there is a space between two or more specified parts that is deliberately designed to have a function. "Spaced apart" does not include space between parts due to tolerances introduced in design, manufacturing, assembly, installation or use. For example, a medium (210, FIG. 2) can be spaced apart from a sidewall (220, FIG. 2) to laterally position the medium for transport into a print engine.

"Prevent" means "impede" or "hinder;" it does not mean "render impossible" or "keep from happening." For example, preventing paper motion in a particular direction does not mean that the paper cannot move in that direction at all; "prevent" includes movement within normal tolerances.

"Sheet" refers to a piece of a planar medium of whatever size, shape or composition, only provided that it meets the definition herein of a planar medium.

Figure 1:
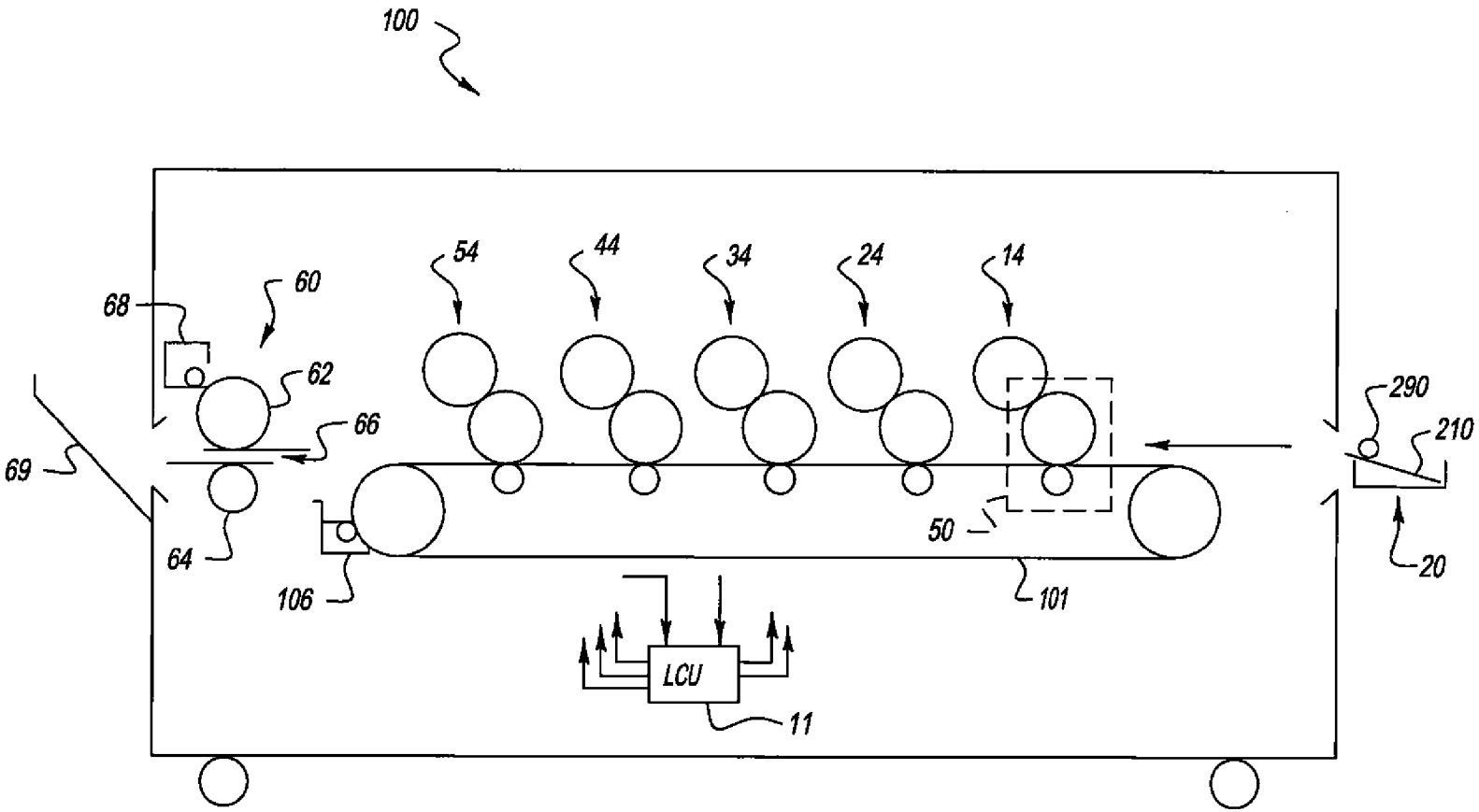
FIG. 1 is an elevational cross-section of an electrographic reproduction apparatus suitable for use with this invention.

FIG. 1 shows printer 100, which will be described further below. Printer 100 includes media-feed apparatus 20 for feeding media 210 into printer 100 using feeder 290.

FIG. 2 shows media-feed apparatus 20 for feeding a planar medium 210 with reduced skew. Apparatus 20 includes feeder 290, which can be a pick roller or belt, a vacuum, or another device or structure for extracting the medium 210. Feeder 290 can be a component of host tray 200 or of printer 100. Feeder 290 can be laterally disposed halfway between sidewalls 220 and 221, or at another location suitable for the printer with which apparatus 20 will be used. Host tray 200 holds medium 210, e.g. cut sheets of paper, transparencies, or plastic. Host tray 200 can hold a plurality of individual sheets of media 210. Medium 210 is extracted from host tray 200 adjacent to feed edge 240 by feeder 290. Sidewall 220, which can be a fixed member or a sliding guide (e.g. sliding sidewalls 224, 225), is perpendicular to feed edge 240. Cavity 260 is adjacent to sidewall 220 for holding the medium. Spring plate 280 is laterally contained within cavity 260 for lifting medium 210 towards feeder 290. In one embodiment, host tray 200 is an injection-molded plastic part.

A planar medium 210, while in media-feed apparatus 20 or printer 100, can be bent out of a planar configuration by elastic or plastic deformation. In one example, the edge of medium 210 closest to feed edge 240 is lifted by spring plate 280, and the edge of medium 210 farthest from feed edge 240 rests against the bottom of cavity 260. This results in a bend in medium 210 located approximately at the edge of spring plate 280 farthest from feed edge 240. The presence of this bend does not imply that medium 210 is not planar. Planar medium 210 is not required to have infinite stiffness or rigidity, or to be a mathematically-ideal plane. Planar medium 210 should preferably be capable of satisfying the description of "planar" above without cutting, tearing, folding, spindling or mutilating. For example, 270 g/m$^2$ greeting card stock can be used as planar medium 210, although such stocks often have some curl when placed in media-feed apparatus 20. Other weights of medium can be used, e.g. 100-300 g/m$^2$, or 75 g/m$^2$ general-purpose copy paper.

"Skew" refers to the orientation of medium 210 passing over feed edge 240 into printer 100 (FIG. 1). It is desirable to feed any sheet of medium 210 into printer 100 at the same angle. Deviations from this angle are "skew." For example, using rectangular media 210 (e.g. a sheet of letter or A4 bond paper), the leading edge 245 of media 210 is preferably parallel to feed edge 240 while being extracted by feeder 290. Skew calculations are discussed further below with reference to FIG. 10. Reduced skew advantageously reduces the chance of paper jams in printer 100. It reduces the risk of a portion of the printed image falling off a skewed medium 210 and thus not being visible. In a duplex system, reduced skew improves the alignment of the images on the two sides of medium 210, advantageously improving quality and user satisfaction of duplexed products (e.g. greeting cards).

Figure 3:
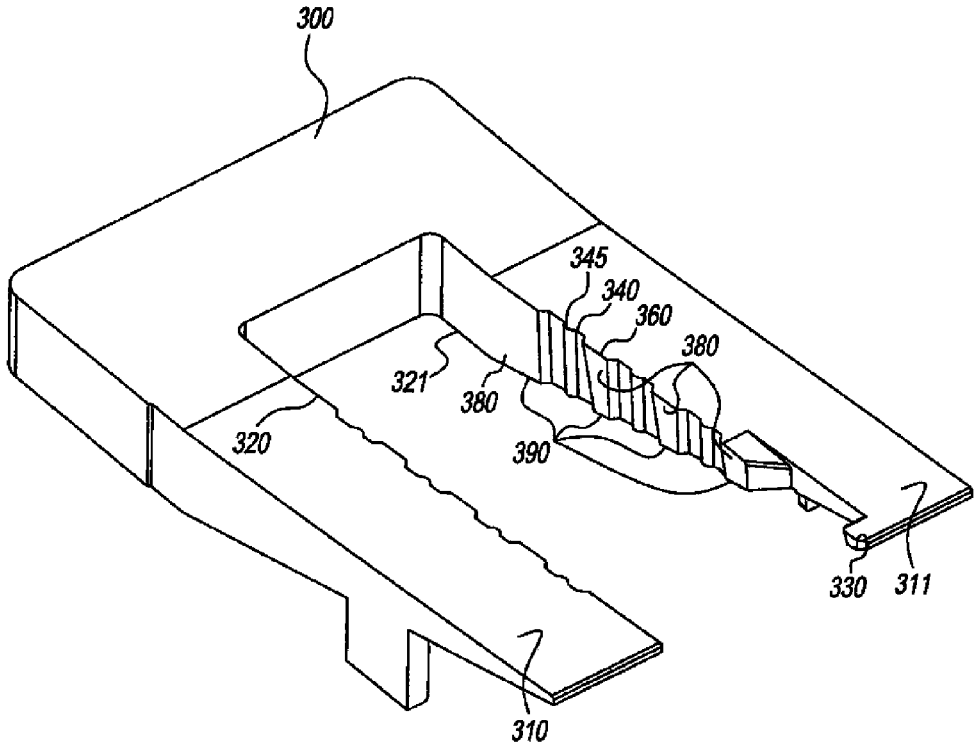
FIG. 3 is an isometric view of a media carrier according to an embodiment of the present invention.

FIG. 3 shows media carrier 300. Media carrier 300 includes an edge guide 310 positioned relative to feed edge 240 and sidewall 220 to prevent the medium 210 from moving toward sidewall 220. Edge guide 310 has an alignment face 320 spaced apart from sidewall 220 and positioned relative to sidewall 220 to orient the medium 210 with respect to the feed edge 240. In one embodiment, media carrier 300 includes one or more injection-molded plastic part(s).

In one embodiment, edge guide 310 is positioned adjacent to feed edge 240 and sidewall 220 so that media 210 is prevented from moving towards sidewall 220. Medium 210 is placed in cavity 260 on the opposite side of edge guide 310 from sidewall 220. Alignment face 320 is parallel to sidewall 220. Therefore, when medium 210 has two perpendicular sides (e.g. is rectangular), it is placed in cavity 260 with one perpendicular side aligned with alignment face 320 and the other perpendicular side closer to feed edge 240 than any remaining side(s) of medium 210. The other perpendicular side will then be parallel to feed edge 240, so medium 210 will feed cleanly and efficiently out of feed edge 240.

In one embodiment, alignment face 320 is not planar. For example, alignment face 320 can include a groove 340 or a protrusion 360. Media guide 440 (FIG. 4, discussed below) can include vertical fingers which fit into corresponding grooves 340 on alignment face 320.

Figure 4:
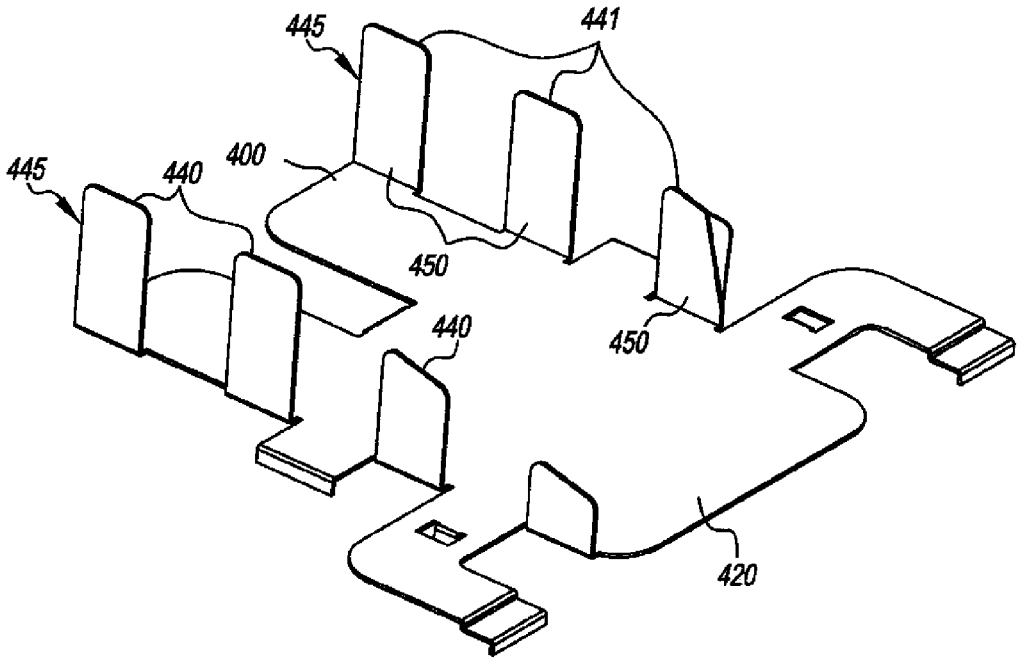
FIG. 4 is an isometric view of an alignment guide according to an embodiment of the present invention.

FIG. 4 shows an alignment guide 400 which is laterally contained within cavity 260 (FIG. 2). Alignment guide 400 includes a media guide 440 and a baseplate 420 for holding medium 210. Baseplate 420 has a selected width greater than the width of medium 210 so that e.g. it can support medium 210 across its width. In one embodiment, the width of baseplate 420 is fixed. Baseplate 420 is disposed over spring plate 280, so that baseplate 420 is lifted when spring plate 280 lifts. In an embodiment, alignment guide 400 is stamped from sheet metal. In an embodiment, alignment guide 400 further includes second media guide 441.

The alignment face 320 (FIG. 3) and alignment guide 440 together advantageously prevent the medium 210 from skewing with respect to the feed edge 240 while the medium is extracted by the feeder 290. To achieve this, alignment guide 400 is positioned relative to alignment face 320, and media guide 440 is positioned relative to baseplate 420 and alignment face 320 and is oriented relative to sidewall 220, respectively, to hold medium 210. In an embodiment, alignment guide 400 is adjacent to alignment face 320. Media guide 440 is adjacent to alignment face 320 and perpendicular vertically to baseplate 420, and parallel to sidewall 220. That is, baseplate 420 is substantially planar so that it can hold planar media. Media guide 440 extends vertically from baseplate 420 towards feed edge 240, i.e. has a long axis substantially parallel to the normal of the plane of baseplate 420. Media guide 440 can be a single sheet of material, one or more independent vertical fingers 445, or another structure for holding medium 210 laterally.

In an embodiment, alignment guide 400 is adjacent to alignment face 321. Media guide 441 is adjacent to alignment face 321 (FIG. 3) and perpendicular vertically to baseplate 420, and parallel to sidewall 221 (FIG. 2).

Embodiments of the present invention can employ only one media guide 440 or two media guides 440, 441, as will be discussed further below. Media guide 441 is related to alignment face 321 and sidewall 221 just as media guide 440 is related to alignment face 320 and sidewall 220.

Referring to FIGS. 3 and 4, in one embodiment, media guide 440 has a side 450 facing medium 210. For example, media guide 440 can be substantially planar, so one face of the plane is the medium-facing side 450. Medium-facing side 450 of media guide 440 and the groove 340 or protrusion 360 of alignment face 320 together provide a planar surface 380. Planar surface 380 can be parallel to sidewall 220, or at an angle to sidewall 220 corresponding to a desired shape of medium 210 (e.g. triangular). This advantageously provides a smooth surface which will not impede medium 210 as it is extracted by feeder 290. Additional grooves 340, protrusions 360, or other features can be provided in edge guide 310 for mechanical clearance.

In one embodiment, media guide 440 includes a plurality of independent, flat fingers 445. Alignment face 320 of edge guide 310 includes a groove 340 corresponding to each finger 445. Grooves 340 provide clearance for fingers 445 to create planar surface 380. To further reduce skew, a groove 340 can include a rail 345 which contacts the side of finger 445 opposite medium-facing side 450. Finger 445 can then ride on rail 345. This advantageously prevents finger 445 from deforming outward toward edge guide 310 under load, and simultaneously provides a low-friction contact between finger 445 and edge guide 310, saving energy, reducing wear and increasing mean time between failure (MTBF). In one embodiment, rail 345 is a half-cylinder (cut lengthwise) to further reduce friction by providing only a line contact with finger 445 and not a surface contact. Rail 345 can also be discontinuous. For example, rail 345 can include a plurality of hemispheres in groove 340, arranged in a linear, checkerboard, or other pattern.

Referring to FIGS. 2-4, there is shown further detail of an embodiment of the present invention. Edge guide 311 (and also edge guide 310) further includes an alignment member 330 located at the end of edge guide 311 closest to feed edge 240, so that medium 210 is aligned by alignment member 330 while being extracted by feeder 290. This advantageously reduces skew of medium 210 as it is being extracted, during which process medium 210 can cease to be completely entrained by alignment guide 400. Alignment member 330 holds the leading edge of medium 210 in alignment with alignment guide 400, which itself holds the trailing edge of medium 210.

Figure 5:
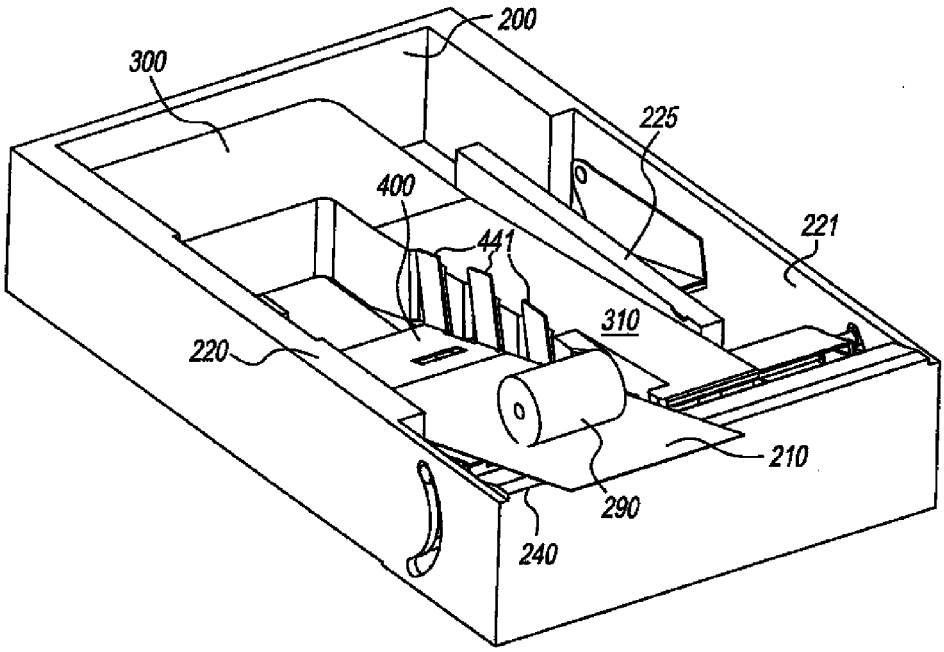
FIG. 5 is an isometric view of an assembly according to an embodiment of the present invention.

FIG. 5 shows an embodiment in which medium 210 is spaced apart from second sidewall 221 of host tray 200. Only one edge guide 310 is used, and medium 210 is retained by sidewall 220 on the side of medium 210 opposite edge guide 310. Edge guide 310 is held in place by sliding sidewall 225. Feeder 290 is disposed closer to sidewall 220 than sidewall 221, and extracts medium 210 adjacent to feed edge 240, as discussed above. Alignment guide 400 is as shown in FIG. 4. In an embodiment, alignment guide 400 has media guide 441, but does not have media guide 440. The edge of medium 210 closest to sidewall 220 is held in alignment by sidewall 220 itself. In an embodiment, edge guide 310 extends to, and is retained by, sidewall 221.

Media carrier 300 is nested immovably in cavity 260, and laterally contained within cavity 260. By "immovably" or "stationary" it is meant that when nested in cavity 260, media carrier 300 is held in place by gravity and does not shift under normal operation ("immovably" and "stationary" also apply to other parts described herein). "Immovably" does not mean that no translational or rotational motion is permitted, and specifically does not require kinematic or other fully-constrained mounting. Rather, "immovably" means that media carrier 300 is not required to undergo motion in order to function: it is intended to be stationary, especially laterally. Note that in an embodiment described above, spring plate 280 contacts the underside of edge guide 310, which can cause vertical motion of media carrier 300 without causing media carrier 300 to cease to be "nested immovably." The vertical motion can include lifting of all or part of media carrier 300, or rotation of media carrier 300 about an axis passing through the center of mass of media carrier 300, an axis passing through an edge of media carrier 300 (e.g. that edge farthest from feed edge 240), or another axis. Media carrier 300 is allowed to shift slightly because of tolerance variability and tolerance and fit clearances. In an embodiment, media carrier 300 and alignment guide 400 are not fastened to host tray 200. Media carrier 300 and alignment guide 400 sit in host tray 200, but are not fastened to the host tray with bolts, screws, pins, pegs, or other fasteners.

Figure 6:
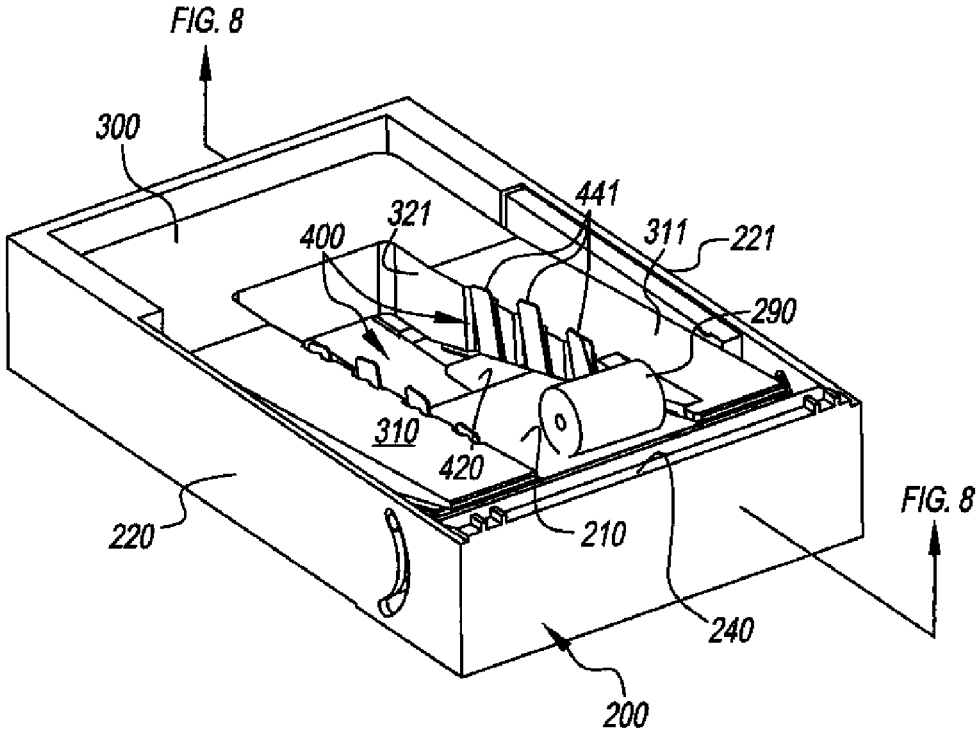
FIG. 6 is an isometric view of an assembly according to another embodiment of the present invention.

FIG. 6 shows an embodiment in which medium 210 is spaced apart from both sidewalls 220 and 221 of host tray 200.

Specifically, host tray 200 includes second sidewall 221 perpendicular to feed edge 240. Sidewalls 220 and 221 are spaced apart so that medium 210 can be placed laterally between them. Media carrier 300 further includes second edge guide 311 positioned relative to feed edge 240 and second sidewall 221 to prevent medium 210 from moving toward second sidewall 221. The two edge guides 310 (FIG. 3), 311 are disposed on opposite sides of the cavity 260. Second edge guide 311 has an alignment face 321 spaced apart from second sidewall 221. This alignment face 321 is positioned relative to second sidewall 221 so that the alignment faces 320 (FIG. 3), 321 of the respective edge guides 310, 311 together orient medium 210 with respect to feed edge 240.

In one embodiment, second edge guide 311 is positioned adjacent to feed edge 240 and second sidewall 221. Alignment face 321 of edge guide 311 is parallel to second sidewall 221.

In this embodiment, alignment guide 400 further includes a second media guide 441. Alignment faces 320, 321 and alignment guide 400 with media guides 440 (FIG. 4), 441 together prevent the paper from skewing with respect to the feed edge 240. Media guides 440, 441 are positioned relative to baseplate 420 and alignment faces 320, 321 are oriented relative to sidewalls 220, 221 to hold the medium 210. Second media guide 441 is perpendicular to baseplate 420 and parallel to second sidewall 221. For example, media guide 441 can extend vertically from baseplate 420 towards feed edge 240, i.e. have a long axis parallel to the normal of the plane of baseplate 420. Media guides 440, 441 are disposed on opposite sides of baseplate 420. For example, when medium 210 has a leading edge and two perpendicular edges on opposite sides of medium 210 (e.g. is rectangular), each media guide 440, 441 holds one of the perpendicular edges while the leading edge is extracted at feed edge 240.

Figure 7:
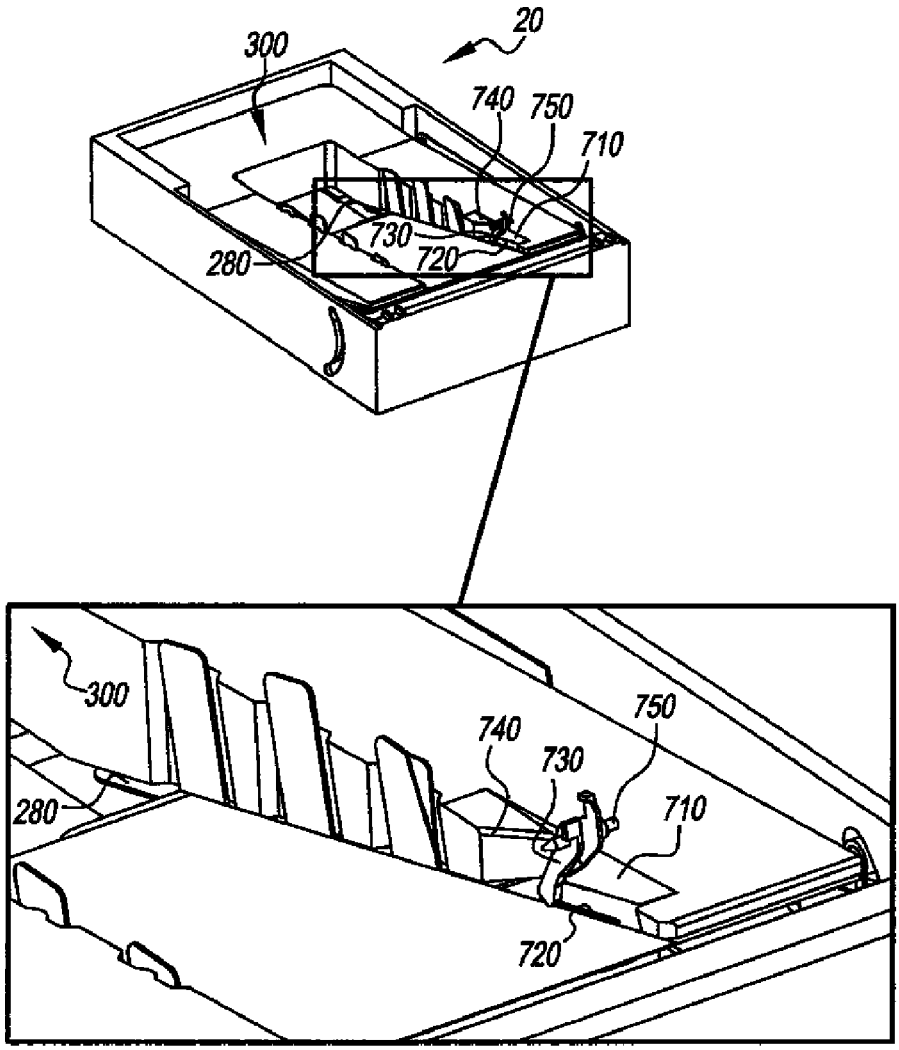
FIG. 7 is an isometric detail view showing media presence detection features of an embodiment of the present invention.

FIG. 7 is an isometric detail view showing media presence detection features of an embodiment of apparatus 20. Media carrier 300 is as shown in FIG. 3 and spring plate 280 is as shown in FIG. 2. Spring plate 280 has slot 720 cut out to permit sensing lever 730 to pass through spring plate 280 when no planar medium is disposed over spring plate 280, e.g. when the host tray 200 is out of paper. Media carrier 300 is relieved at notch 710 to provide clearance for sensing lever 730. In one embodiment, sensing lever 730 is attached to printer 100 (FIG. 1) and not attached to apparatus 20 (FIG. 2). Therefore, when apparatus 20 (FIG. 2 host tray 200, and associated parts as described above) is installed in or removed from printer 100, sensing lever 730 pivots about axle 750. Notch 710 can include radiused or beveled edge 740 to advantageously reduce binding of sensing lever 730 and its axle 750 as apparatus 20 is installed or removed. This and other embodiments advantageously permit the media-sensing mechanism of printer 100 to operate as if larger-sized media were present.

Figure 8:
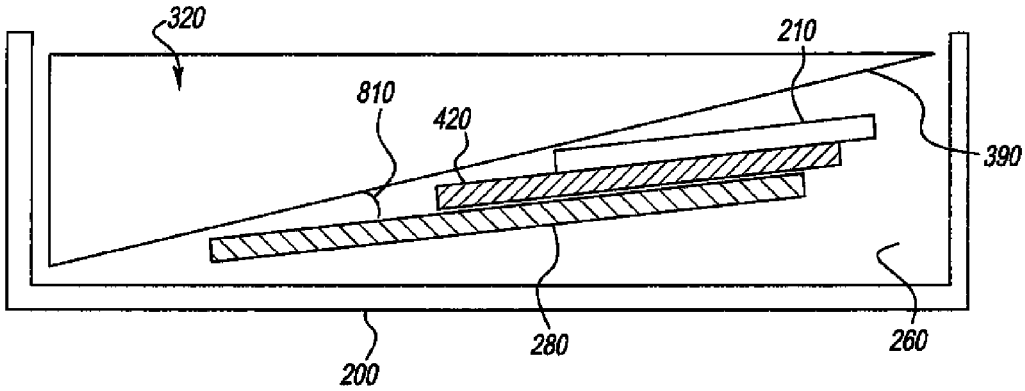
FIG. 8 is a partial cross-section taken along line 8-8 in FIG. 6.

FIG. 8 shows a cross-section taken along line 8-8 in FIG. 6. Host tray 200 and cavity 260 are as shown in FIG. 2. In one embodiment, alignment face 320 includes a print biasing edge 390 which forms an acute angle 810 with spring plate 280 through the travel of spring plate 280. If medium 210 skews slightly and is caught between print biasing edge 390 and spring plate 280, or between print biasing edge 390 and baseplate 420, medium 210 will experience a longitudinal force at acute angle 810. In an embodiment, medium 210 will also experience a lateral force at acute angle 810, as will be discussed further below. The lateral force (e.g. parallel to feed edge 240) will move medium 210 out of acute angle 810 and therefore will release it from being caught. This advantageously improves reliability of the paper-feed apparatus.

Print biasing edge 390 can be radiused or chamfered (i.e. cut at an angle e.g. 45°), as can the portion of spring plate 280 closest to print biasing edge 390. Adding a radius or chamfer advantageously reduces the magnitude of the friction resisting the lateral force, further improving reliability. A radius or chamfer can also increase the magnitude of the lateral force component directly, e.g. a 45° chamfer, therefore a force at an angle of 45° to the normal of medium 210, has vertical and lateral force components. In various embodiments, the radius changes down the length of print biasing edge 390, or the chamfer angle changes down that length.

Figure 9A:
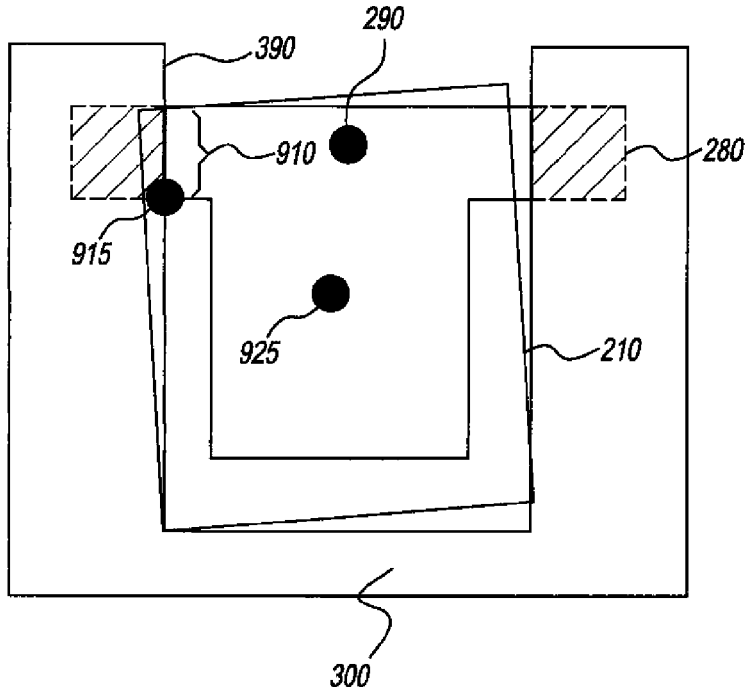
FIG. 9A is a plan view illustrating reduction of skew according to an embodiment of the present invention.

FIG. 9A shows a top view of medium 210 disposed over spring plate 280 and caught in acute angle 810 (FIG. 8) between spring plate 280 and print biasing edge 390 of media carrier 300. Medium 210 is being extracted by feeder 290, represented here as a point. The skew of medium 210 is exaggerated in this figure for purposes of illustration. In interference area 910, e.g. at point 915, force is exerted on medium 210.

Figure 9B:
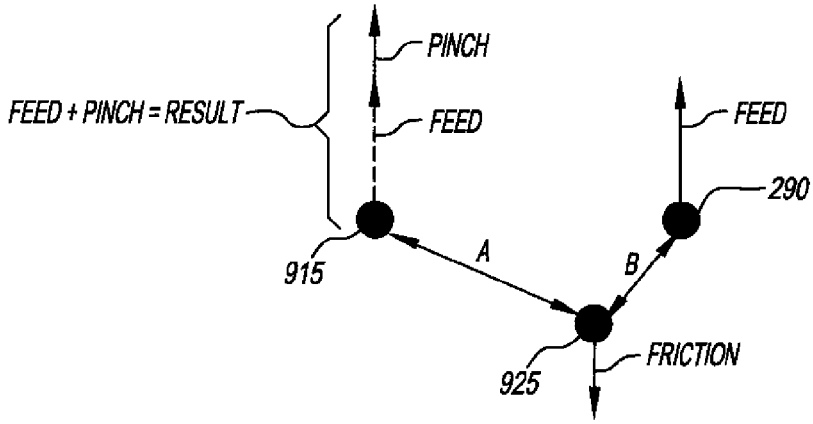
FIG. 9B is a free-body diagram of the situation shown in FIG. 9A.

FIG. 9B shows a free-body diagram of the configuration of FIG. 9A. Medium 210 experiences a feed force produced by feeder 290, which operates throughout medium 210 when medium 210 is a solid. An additional pinch force having a positive magnitude in the direction of the feed force occurs at point 915, where spring plate 280, medium 210 and print biasing edge 390 are in mechanical contact. As discussed above with reference to FIG. 8, this longitudinal pinch force is exerted on medium 210 and tends to squeeze medium 210 out of acute angle 810. The resultant component of force at point 915 in the direction of the feed force is the feed force plus the positive-magnitude pinch force component in that direction. The friction force of medium 210, e.g. on spring plate 280, is shown at point 925, the center of mass of medium 210, where it opposes the feed force.

In the example of FIGS. 9A and 9B, the torque exerted on the paper at point 915 (feed plus pinch forces, at distance "A" from the center of mass) exceeds the torque exerted on the paper by feeder 290 (feed force, at distance "B" from the center of mass). Medium 210 therefore experiences angular acceleration and thus rotates away from interference area 910 (clockwise, in this example). Medium 210 becomes more closely aligned with feed edge 240 and so has reduced skew.

Referring back to FIGS. 2 and 3, in one embodiment, edge guide 310 is positioned vertically so that spring plate 280 contacts edge guide 310 before reaching full travel. This advantageously reduces the chance of medium 210 being trapped between spring plate 280 and edge guide 310, especially when a limited number of sheets of medium 210 are in cavity 260. Specifically, spring plate 280 can contact the underside of edge guide 310 before the last sheet of medium 210 is lifted to feeder 290, or before the top of a small stack of sheets, e.g. ≦12 sheets, of medium 210 is lifted to feeder 290. This advantageously provides reduced skew through an entire stack of media, as the edge guide 310 remains vertically stationary (in the sense defined above) with respect to medium 210 through the extraction of the last sheet of medium 210.

Specifically, multiple sheets of planar media are disposed in the host tray over the spring plate and extracted one at a time. A vertical stack of sheets are placed in host tray 200, and the top sheet is extracted, followed by the sheet formerly below it, and so on, until all sheets have been extracted. Once a selected number (≧0) of sheets has been extracted, spring plate 280 contacts media carrier 300, e.g. at at least one point. Media carrier 300 is then lifted by spring plate 280 as successive sheets of medium 210 are extracted from host tray 200. This advantageously reduces the probability of a gap being present between media carrier 300 and spring plate 280 where media can bind (become stuck) prior to exiting host tray 200.

Figure 10:
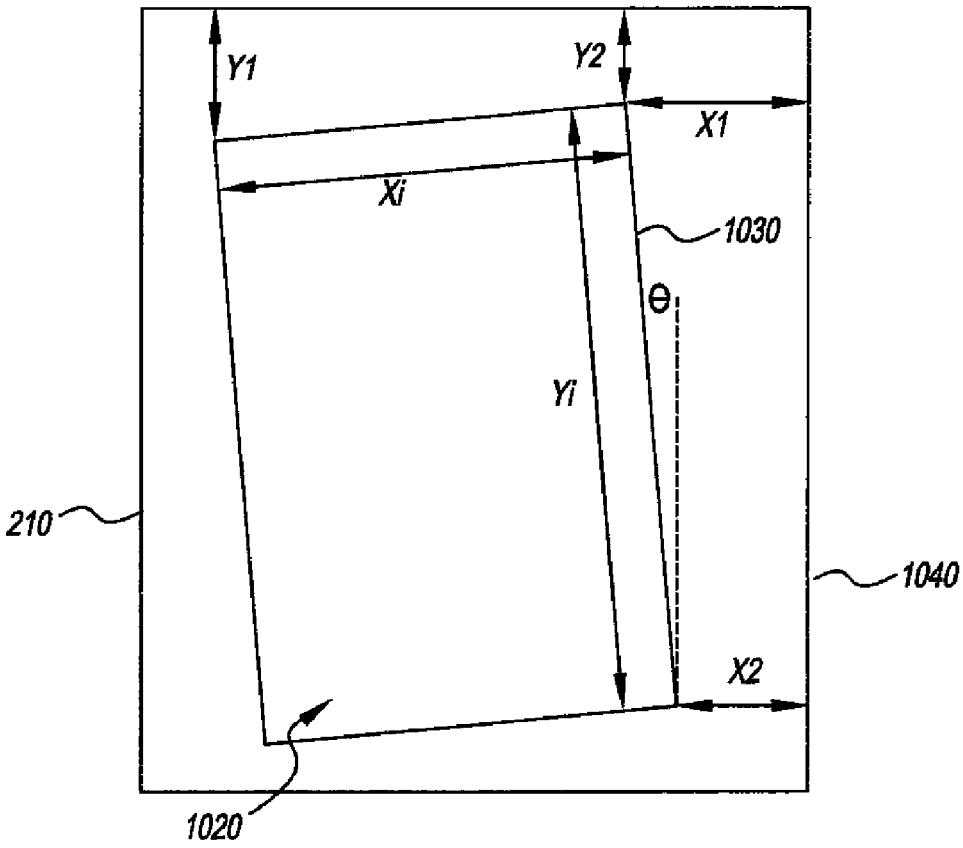
FIG. 10 is a plan view of skew calculations according to an embodiment of the present invention.

FIG. 10 shows a calculation of skew on an image according to an embodiment of the invention. In this example, the image is rectangular, but other image shapes can be used. Furthermore, skew can be measured for a non-rectangular image contained entirely within a rectangular bounding box. FIG. 10 shows a portrait image, but the same calculation is used for a landscape image.

Medium 210 has image 1020 (which can be a bounding box, as described above) printed on it in a portrait configuration. That is, the long axis 1030 of image 1020 is oriented less than 45° away from the long axis 1040 of medium 210 (for a landscape image, more than 45° away). The skew of image 1020 is exaggerated for clarity. Distance X1 is the distance from one corner of image 1020 (e.g. the upper-right corner) to the closest edge of medium 210 along a direction orthogonal to long axis 1040. Distance X2 is the distance from an adjacent corner (i.e. not diagonally-opposite; in this example, the lower-right corner) to the closest edge of medium 210 along a direction orthogonal to long axis 1040. Distance Yi is the length of the axis 1030 of image 1020 most closely aligned to the process (in-track) direction (the long axis for a portrait image, or the short axis for a landscape image). The percent skew on the image is $|X1-X2|/Yi$, and is preferably less than or equal to 1% (0.01).

In an embodiment, printer 100 produces image 1020 having sides parallel and perpendicular (within tolerances, as described above) to feed edge 240. Image 1020 and medium 210 are rectangular. The skew angle θ of image 1020 with respect to medium 210 is $\theta=\sin^{-1}[(X1-X2)/Yi]$. Therefore $Y1=Y2+Xi\cdot\sin(\theta)$, or equivalently, $\theta=\sin^{-1}[(Y1-Y2)/Xi]$.

Percent skew is preferably $\leqq 0.01$, so θ is preferably within ±0.01 rad, or approximately ±0.573°. Therefore the leading edge 245 of medium 210 preferably has a skew angle of within approximately ±0.573° with respect to the length of an image to be printed on medium 210. That is, $|Y1-Y2|/Xi \leqq 0.01$: the absolute value of the difference between the point on leading edge 245 farthest from the feed edge 240 in the plane of medium 210 and the point on leading edge 245 closest to feed edge 240 in that plane, divided by the intended image dimension parallel to feed edge 240, is less than or equal to 1%.

The components of media-feed apparatus 20 are readily inserted and removed by operators of printer 100, advantageously producing consistent results, and reducing the time and effort of a media-size change. In one embodiment, the parts nest into and next to each other and are not fastened to host tray 200, making installation and removal of apparatus 20 simple and fast. This is advantageous in minilab and kiosk environments, in which operators are required to change paper size quickly to meet unpredictable consumer demand and to print rush jobs.

An Electrophotographic Embodiment

Media-feed apparatus 20 can be employed in inkjet, electrophotographic, and other types of copiers and printers. In one embodiment, the media-feed apparatus is employed in a printer implementing the electrographic method. This method can be embodied in devices including printers, copiers, scanners, and facsimiles, and analog or digital devices. This method applies to electrophotographic printers and copiers that employ dry toner developed on an electrophotographic receiver element, as well as ionographic printers and copiers that do not rely upon an electrophotographic receiver.

Electrophotography (also known as electrostatography or xerography) is a useful method for printing images on a receiver member, such as a sheet of paper. In this method, an electrostatic latent image is formed on a dielectric photoreceptor by uniformly charging the photoreceptor and then discharging selected areas of the uniform charge to yield an electrostatic charge pattern corresponding to the desired image (a "latent image").

After the latent image is formed, marking particles (known as toner, dry ink, or developer) are given a charge substantially opposite to the charge of the latent image, and brought into the vicinity of the photoreceptor so as to be attracted to the latent image to develop the latent image into a visible image.

After the latent image is developed into a visible image on the photoreceptor, a suitable receiver member is brought into juxtaposition with the visible image. A suitable electric field is applied to transfer the marking particles of the visible image to the receiver member to form the desired print image on the receiver member. The imaging process is typically repeated many times with reusable photoreceptors.

The receiver member is then removed from its operative association with the photoreceptor and subjected to heat or pressure to permanently fix ("fuse") the marking particle print image to the receiver member. Plural marking-particle images, e.g. of separations of different colors, are overlaid on one receiver member before fusing to form a multi-color print image on the receiver member.

Electrophotographic printers typically transport the receiver member past the photoreceptor to form the image. The direction of travel of the receiver is referred to as the slow-scan or process direction. This is typically the vertical (Y) direction of a portrait-oriented receiver. The direction perpendicular to the slow-scan direction is referred to as the fast-scan or cross-process direction, and is typically the horizontal (X) direction of a portrait-oriented receiver.

Digital reproduction printing systems ("printers") typically include digital front-end processors, a digital print engine, and post-printing finishing systems (e.g. a UV coating system, a glosser system, or a laminator system). A printer reproduces original pleasing black-and-white or color onto substrates (such as paper). The digital front-end processors take input electronic files (such as Postscript command files) composed of images from other input devices (e.g., a scanner, a digital camera) together with its own internal other function processors (e.g., raster image processor, image positioning processor, image manipulation processor, color processor, image storage processor, or substrate processor) to rasterize input electronic files into image bitmaps for the print engine to print.

Digital front-end processors can permit operators to set up parameters such as layout, font, color, paper, or post-finishing options. The print engine takes the rasterized image bitmap from the front-end processor and renders the bitmap into a form that can control the printing process from the exposure device to writing the image onto paper. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g. the electrophotographic process) to provide known, consistent color reproduction characteristics. The color management system can also provide known color reproduction for different inputs (e.g. digital camera images or film images).

In an electrophotographic modular printing machine, e.g. the Nexpress 2100 printer manufactured by Eastman Kodak Company of Rochester, N.Y., color toner images are made sequentially in a plurality of color imaging modules arranged in tandem, and the toner images are successively electrostatically transferred to a receiver member adhered to a transport web moving through the modules. Colored toners include colorants, e.g. dyes or pigments, which absorb specific wavelengths of visible light. Commercial machines of this type typically employ intermediate transfer members in the respective modules for the transfer to the receiver member of individual color separation toner images. Of course, in other electrostatographic printers, each color separation toner image is directly transferred to a receiver member.

Electrostatographic printers having multicolor capability are known to also provide an additional toner depositing assembly for depositing clear toner. The provision of a clear toner overcoat to a color print is desirable for providing protection of the print from fingerprints and reducing certain visual artifacts. However, a clear toner overcoat will add cost and can reduce color gamut of the print; thus, it is desirable to provide for operator/user selection to determine whether or not a clear toner overcoat will be applied to the entire print. A uniform layer of clear toner can be provided. A layer that varies inversely according to heights of the toner stacks can also be used to establish level toner stack heights. The respective color toners are deposited one upon the other at respective locations on the receiver member and the height of a respective color toner stack is the sum of the toner contributions of each respective color. Uniform stack height provides the print with a more even or uniform gloss.

FIG. 1 is an elevational cross-section showing portions of a typical electrographic printer 100 adapted to print images, such as single-color (monochrome), CMYK, or pentachrome (five-color) images, on a receiver (multicolor images are also known as "multi-component" images). Images can include text, graphics, photo, and other types of visual content. One embodiment of the invention involves printing using an electrophotographic engine having five sets of single-color image-producing or -printing stations or modules arranged in tandem, but more or less than five colors can be combined on a single receiver member. Other electrographic writers or printer apparatus can also be included. Various components of printer 100 are shown as rollers; other configurations are also possible, including belts. Printer 100 can be a copier, printer, or other reproduction apparatus, as described above.

As discussed above, printer 100 includes media-feed apparatus 20 for feeding media 210 into printer 100 using feeder 290.

Printer 100 is an electrographic printing apparatus having a number of tandemly-arranged electrostatographic image-forming printing modules 14, 24, 34, 44, 54, also known as electrographic imaging subsystems. Each of the printing modules produces a single-color toner image for transfer using a respective transfer station 50 (for clarity, only one is labeled) to a receiver member successively moved through the modules. In various embodiments, the visible image is transferred directly from an imaging roller to a receiver member, or from an imaging roller to one or more transfer roller(s) or belt(s) in sequence in transfer station 50, and thence to a receiver member. The receiver member is, for example, a selected section of a web of, or a cut sheet of, planar media such as paper or transparency film.

Each receiver member, during a single pass through the five modules, can have transferred in registration thereto up to five single-color toner images to form a pentachrome image. As used herein, the term "pentachrome" implies that in an image formed on a receiver member, combinations of various of the five colors are combined to form other colors on the receiver member at various locations on the receiver member, and that all five colors participate to form process colors in at least some of the subsets. That is, each of the five colors of toner can be combined with toner of one or more of the other colors at a particular location on the receiver member to form a color different than the colors of the toners combined at that location. In a particular embodiment, printing module 14 forms black (K) toner color separation images, 24 forms yellow (Y) toner color separation images, 34 forms magenta (M) toner color separation images, and 44 forms cyan (C) toner color separation images.

Printing module 54 can form a red, blue, green, or other fifth color separation image, including an image formed from a clear toner (i.e. one lacking pigment). The four subtractive primary colors, cyan, magenta, yellow, and black, can be combined in various combinations of subsets thereof to form a representative spectrum of colors. The color gamut or range of a printer is dependent upon the materials used and process used for forming the colors. The fifth color can therefore be added to improve the color gamut. In addition to adding to the color gamut, the fifth color can also be a specialty color toner or spot color, such as for making proprietary logos or colors that cannot be processed as a combination of CMYK colors (e.g. metallic, fluorescent or pearlescent colors), or a clear toner for image protective purposes or other uses. Clear toner uses particles that are similar to the toner marking particles of the color development stations but without colored material (e.g. dye or pigment) incorporated into the toner binder.

Subsequent to transfer of the respective color separation images, overlaid in registration, one from each of the respective printing modules 14, 24, 34, 44, 54, the receiver member is advanced to a fuser 60, i.e. a fusing or fixing assembly, to fuse the multicolor toner image to the receiver member. Transport web 101 transports the toner-image-carrying receiver members to fuser 60, which fixes the toner particles to the respective receiver members by the application of heat and pressure. The receiver members are serially de-tacked from transport web 101 to permit them to feed cleanly into fuser 60. Transport web 101 is then reconditioned for reuse at cleaning station 106 by cleaning and neutralizing the charges on the opposed surfaces of the transport web 101.

Fuser 60 includes a heated fusing roller 62 and an opposing pressure roller 64 that form a fusing nip 66 therebetween. Fuser 60 also includes a release fluid application substation 68 that applies release fluid, e.g. silicone oil, to fusing roller 62. Other embodiments of fusers, both contact and non-contact, can be employed with the present invention. For example, solvent fixing uses solvents to soften the toner particles so they bond with the receiver. Photoflash fusing uses short bursts of high-frequency electromagnetic radiation (e.g. ultraviolet light) to melt the toner. Radiant fixing uses lower-frequency electromagnetic radiation (e.g. infrared light) to more slowly melt the toner. Microwave fixing uses electromagnetic radiation in the microwave range to heat the receiver members (primarily), thereby causing the toner particles to melt by heat conduction, so that the toner is fixed to the receiver member.

The receiver members carrying the fused image are transported in a series from the fuser 60 along a path either to a remote output tray 69, or back to printing modules 14 et seq. to create an image on the backside of the receiver member, i.e. to form a duplex print. Receiver members can also be transported to any suitable output accessory. For example, an auxiliary fuser or glossing assembly can provide a clear toner overcoat. Printer 100 can also include multiple fusers 60 to support applications such as overprinting, as known in the art.

Printer 100 includes a main printer-apparatus logic and control unit (LCU) 11, which receives input signals from the various sensors associated with printer 100 and sends control signals to the components of printer 100. The LCU can include a microprocessor incorporating suitable look-up tables and control software executable by the LCU 11. It can also include a field-programmable gate array (FPGA), programmable logic device (PLD), microcontroller, or other digital control system. The LCU can include memory for storing control software and data. Sensors associated with the fusing assembly provide appropriate signals to the LCU 11. In response to the sensors, the LCU 11 issues command and control signals that adjust the heat or pressure within fusing nip 66 and other operating parameters of fuser 60 for imaging substrates. This permits printer 100 to print on receivers of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of respective LED writers, e.g. for black (K), yellow (Y), magenta (M), cyan (C), and red (R), respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes including color correction, in order to obtain the desired color print. Color image data is separated into the respective colors and converted by the RIP to halftone dot image data in the respective color using matrices, which comprise desired screen angles and screen rulings. The RIP can be a suitably-programmed computer or logic device and is adapted to employ stored or computed matrices and templates for processing separated color image data into rendered image data in the form of halftone information suitable for printing.

Further details regarding printer 100 are provided in U.S. Pat. No. 6,608,641, issued on Aug. 19, 2003, by Peter S. Alexandrovich et al., and in U.S. Pub. No. 2006/0133870, published on Jun. 22, 2006, by Yee S. Ng et al., the disclosures of which are incorporated herein by reference.

The invention has been described in detail with particular reference to certain embodiments thereof, but it will be understood that variations, combinations, and modifications can be effected within the spirit and scope of the invention.

PARTS LIST

11 logic and control unit (LCU)
14, 24, 34, 44, 54 printing module
20 media-feed apparatus
50 transfer station
60 fuser
62 fusing roller
64 pressure roller
66 fusing nip
68 release fluid application substation
69 output tray
100 printer
101 transport web
106 cleaning station
200 host tray
210 planar media
220 sidewall
221 sidewall
224 sliding sidewall
225 sliding sidewall
240 feed edge
245 leading edge
260 cavity
280 spring plate
290 feeder
300 media carrier
310 edge guide
311 edge guide
320 alignment face
321 alignment face
330 alignment member
340 groove
345 rail
360 protrusion
380 planar surface
390 print biasing edge
400 alignment guide
420 baseplate
440 media guide
441 media guide
445 finger
450 medium-facing side
710 notch
720 slot
730 sensing lever
740 edge
750 axle
810 acute angle
910 interference area
915 point
925 point
1020 image
1030 long axis
1040 long axis

The invention claimed is:

1. A media-feed apparatus for feeding a planar medium, comprising:

a) a feeder;

b) a host tray out of which the medium is extracted by the feeder, including a feed edge adjacent to which the medium is extracted, a sidewall perpendicular to the feed edge, a cavity adjacent to the sidewall for holding the medium, and a spring plate wider than the medium laterally contained within the cavity for lifting the medium towards the feeder;

c) a media carrier nested immovably in the cavity and laterally contained within the cavity, and including an edge guide positioned relative to the feed edge and the sidewall to prevent the medium from moving toward the sidewall, the edge guide having an alignment face spaced apart from the sidewall and positioned relative to the sidewall to orient the medium with respect to the feed edge, the alignment face including a print biasing edge;

d) an alignment guide laterally contained within the cavity and having a media guide and a baseplate of a selected width greater than a width of the medium and disposed over the spring plate, so that the baseplate is lifted when the spring plate lifts, and the print biasing edge forms an acute angle with the spring plate through the travel of spring plate; and e) wherein the alignment guide is positioned relative to the alignment face and the media guide is positioned relative to the baseplate and the alignment face and is oriented relative to the sidewall to hold the medium so that the alignment face and alignment guide together prevent the medium from skewing with respect to the feed edge while the medium is extracted by the feeder.

2. The apparatus of claim 1, wherein the edge guide is positioned adjacent to the feed edge and the sidewall, the alignment face is parallel to the sidewall, the alignment guide is adjacent to the alignment face, and the media guide is adjacent to the alignment face, perpendicular to the baseplate, and parallel to the sidewall.

3. The apparatus of claim 1, wherein the media carrier is not fastened to the host tray.

4. The apparatus of claim 1, wherein the edge guide further includes an alignment member located at the end of the edge guide closest to the feed edge, so that the medium is aligned by the alignment member while being extracted by the feeder.

5. The apparatus of claim 1, wherein the alignment face is not planar.

6. The apparatus of claim 5, wherein the alignment face includes a groove or a protrusion.

7. The apparatus of claim 6, wherein the media guide has a side facing the medium and the medium-facing side of the media guide and the groove or the protrusion of the alignment face together provide a planar surface.

8. The apparatus of claim 7, wherein the planar surface is parallel to the sidewall.

9. The apparatus of claim 1, wherein the host tray further includes a second sidewall perpendicular to the feed edge, the two sidewalls being spaced apart, and the media carrier further includes a second edge guide positioned relative to the feed edge and the second sidewall to prevent the medium from moving toward the second sidewall, the second edge guide having an alignment face spaced apart from the second sidewall and positioned relative to the second sidewall so that the alignment faces of the respective edge guides together orient the medium with respect to the feed edge, wherein the two edge guides are disposed on opposite sides of the cavity.

10. The apparatus of claim 9, wherein the second edge guide is positioned adjacent to the feed edge and the second sidewall and the alignment face is parallel to the second sidewall.

11. The apparatus of claim 9, wherein the alignment guide further includes a second media guide, and the media guides are positioned relative to the baseplate and the alignment faces are oriented relative to the sidewalls to hold the medium so that the alignment faces and alignment guide together prevent the medium from skewing with respect to the feed edge.

12. The apparatus of claim 11, wherein the second media guide is perpendicular to the baseplate and parallel to the second sidewall, and the two media guides are disposed on opposite sides of the baseplate.

* * * * *